US007337921B2

(12) United States Patent
Ma

(10) Patent No.: US 7,337,921 B2
(45) Date of Patent: Mar. 4, 2008

(54) TWIST-OPEN CLOSURE HAVING INCLINED FRANGIBLE MEMBRANE

(75) Inventor: Mike Xiaoli Ma, San Jose, CA (US)

(73) Assignee: Portola Packaging, Inc., Batavia, IL (US)

( * ) Notice: Subject to any disclaimer, the term of this patent is extended or adjusted under 35 U.S.C. 154(b) by 0 days.

(21) Appl. No.: 10/525,143

(22) PCT Filed: Sep. 16, 2004

(86) PCT No.: PCT/US2004/030476

§ 371 (c)(1),
(2), (4) Date: Feb. 16, 2005

(65) Prior Publication Data

US 2006/0057257 A1 Mar. 16, 2006

Related U.S. Application Data

(60) Provisional application No. 60/515,220, filed on Oct. 27, 2003.

(51) Int. Cl.

| | |
|---|---|
| ***A21B 10/02*** | (2006.01) |
| ***B65D 1/024*** | (2006.01) |
| ***B65D 47/01*** | (2006.01) |
| ***B67D 5/00*** | (2006.01) |
| ***B67D 3/00*** | (2006.01) |
| ***B67D 5/06*** | (2006.01) |

(52) U.S. Cl. ..... 222/83.5; 222/525; 222/541.2; 222/145.1; 220/529; 426/112

(58) Field of Classification Search ..... 426/120, 426/124, 112; 220/500, 506, 502, 529, 23.83, 220/258.1–258.5, 255.1; 215/6, DIG. 8; 222/81–83.5, 88, 525, 519–521, 541, 541.2, 222/548, 145.5, 219, 221, 145.1, 499; 206/219, 206/221, 222

See application file for complete search history.

(56) References Cited

U.S. PATENT DOCUMENTS 3,156,369 A 11/1964 Bowes et al.

(Continued)

FOREIGN PATENT DOCUMENTS

EP 0 552 105 A1 7/1993

(Continued)

*Primary Examiner*—Kevin Shaver
*Assistant Examiner*—Melvin A. Cartagena
(74) *Attorney, Agent, or Firm*—James P. Hanrath; Adam K. Sacharoff

(57) ABSTRACT

A closure for a container having an opening includes a base cap and an overcap that form a sealed chamber adjacent the opening that is isolated from the contents of the container. The base cap includes an outer skirt having container-engaging structure, a cylindrical well, a frangible membrane connected to the well along an inclined line of weakness and by a hinge member. The hinge member includes a pocket extending downward adjacent lower and upper terminuses of the line of weakness. The overcap includes a body having gripping structure, an inner skirt received within and rotatably connected to the well, and a cutting member depending from a lower end of the inner skirt received within the pocket such that the cutting member extends below the upper terminus. The cutting member severs the line of weakness upon substantial rotation of the overcap with respect to the base cap. A method of using the closure is also disclosed.

17 Claims, 8 Drawing Sheets

U.S. PATENT DOCUMENTS

| | | | |
|---|---|---|---|
| 3,207,375 | A | 9/1965 | Bereziat et al. |
| 3,840,136 | A | 10/1974 | Lanfranconi et al. |
| 4,195,731 | A | 4/1980 | Cavazza |
| 4,221,291 | A | 9/1980 | Hunt |
| 4,884,705 | A | 12/1989 | Debetencourt |
| 4,967,941 | A | 11/1990 | Beck |
| 5,038,951 | A | 8/1991 | Rizzardi |
| 5,170,888 | A | 12/1992 | Goncalves |
| 5,292,025 | A | 3/1994 | Dubreul |
| 5,927,549 | A | 7/1999 | Wood |
| 6,105,760 | A | 8/2000 | Mollstam et al. |
| 6,116,445 | A | 9/2000 | Ikemori et al. |
| 6,148,996 | A | 11/2000 | Morini |
| 6,209,718 | B1 | 4/2001 | Mollstam et al. |
| 6,230,884 | B1 | 5/2001 | Coory |
| 6,367,622 | B1 | 4/2002 | Hsu |
| 6,454,088 | B2 | 9/2002 | Mollstam et al. |
| 6,477,743 | B1 | 11/2002 | Gross et al. |
| 6,513,650 | B2 | 2/2003 | Mollstam et al. |
| 6,571,994 | B1 | 6/2003 | Adams et al. |
| 6,679,375 | B1 | 1/2004 | Coory |
| 6,702,161 | B2 | 3/2004 | Adams et al. |
| 6,705,462 | B2 | 3/2004 | Kasuya |
| 6,766,903 | B1 | 7/2004 | Yehhsu |
| 6,769,539 | B2 | 8/2004 | Stern et al. |
| 6,786,330 | B2 | 9/2004 | Mollstam et al. |
| 6,840,373 | B2 | 1/2005 | Gibler et al. |
| 6,935,493 | B2 | 8/2005 | Cho |
| 2002/0030056 | A1 | 3/2002 | Hsu |
| 2002/0066748 | A1 | 6/2002 | Weiler et al. |
| 2002/0096440 | A1 | 7/2002 | Kasuya |
| 2003/0071089 | A1 | 4/2003 | Ma et al. |
| 2003/0106911 | A1 | 6/2003 | Adams et al. |
| 2003/0127467 | A1 | 7/2003 | Adams et al. |
| 2003/0132244 | A1 | 7/2003 | Birkmayer et al. |
| 2003/0230546 | A1* | 12/2003 | Yurkewicz et al. ..... 215/251 |
| 2005/0205438 | A1* | 9/2005 | Hierzer et al. ..... 206/222 |

FOREIGN PATENT DOCUMENTS

| | | |
|---|---|---|
| WO | WO 98/38104 A1 | 9/1998 |
| WO | WO 01/08996 A1 * | 2/2001 |

* cited by examiner

TWIST-OPEN CLOSURE HAVING INCLINED FRANGIBLE MEMBRANE

CROSS-REFERENCES TO RELATED APPLICATIONS

This application is a National Stage of International Patent Application No. PCT/US2004/030476 filed Sep. 16, 2004 and entitled TWIST-OPEN CLOSURE HAVING INCLINED FRANGIBLE MEMBRANE, which application claims priority to U.S. Provisional Patent Application No. 60/515,220 filed Oct. 27, 2003 and also entitled TWIST-OPEN CLOSURE HAVING INCLINED FRANGIBLE MEMBRANE, the entire contents of which is incorporated herein by this reference the entire contents of which is incorporated herein by this reference.

BACKGROUND OF THE INVENTION

1. Field of the Invention

This invention relates, in general, to closures for containers and more particularly to twist-open closures having an inclined frangible membrane and methods for their use.

2. Description of Related Art

Closures designed to store a consumable separate from a liquid until use are known. For example, U.S. patent application Ser. No. 10/313,575 discloses a closure including a cap, a rotatable spout, piercing structure and a sealing foil that encases a consumable material such as a tablet. The piercing structure is adapted to pierce the sealing foil and bias the foil downwardly in order to facilitate the introduction of the tablet into the liquid of a container upon rotation of the spout relative to the cap.

While the above structure is quite effective to isolate the consumable material from the contents of the container until use, in some instances a discrete sealing foil may prove undesirable. An exemplar of a prior art closure, which does not require a discrete sealing foil, is International Application Publication No. WO 01/08996 to Yu, which publication shows a spin-opening type bottle cap for separating solute and solvent. Disadvantageously, such prior bottle caps may require a significant amount of force on the part of a user to initiate opening of the bottle cap. Furthermore, prior caps are often more complicated to manufacture. For example, as very precise alignment of parts is often necessary to assembly prior caps.

What is needed is a twist-open closure that overcomes the above and other disadvantages of known closures.

BRIEF SUMMARY OF THE INVENTION

In summary, one aspect of the present invention is directed to a closure for a container having an opening includes a base cap and an overcap that form a sealed chamber adjacent the opening, which chamber is isolated from the contents of the container. The base cap may include an outer skirt having container-engaging structure, a cylindrical well, a frangible membrane connected to the well along an inclined line of weakness and by a hinge member. The hinge member may include a pocket extending downward adjacent lower and upper terminuses of the line of weakness. The overcap may include a body having gripping structure, an inner skirt received within and rotatably connected to the well, and a cutting member depending from a lower end of the inner skirt received within the pocket such that the cutting member extends below the upper terminus.

The cutting member preferably severs the line of weakness upon substantial rotation of the overcap with respect to the base cap.

The cutting member may be approximately one-eighth inch high. The cutting member may include an angled knife-edge. In one embodiment, relative rotation between the overcap and the base cap in excess of approximately 0-10° causes the cutting member to at least partially sever the line of weakness. The container-engaging structure may include container-engaging thread dimensioned and configured to cooperate with closure-engaging thread of the container. The closure may further include a tamper-evidencing base band frangibly connected to a lower end of the outer base cap skirt. The closure may further include a tamper-evidencing overcap band frangibly connected to a lower end of the overcap body and operably engaging tamper-evidencing structure on the base cap. The overcap band may include an inwardly-extending protrusion extending inwardly and operably engaging an outwardly-extending protrusion on the base cap. In one embodiment, relative rotation between the overcap and the base cap in excess of approximately 0-5° causes the overcap band to at least partially separate from the overcap body. A first amount of relative rotation between the overcap and the base cap may be required to at least partially separate the overcap band from the overcap body and a second amount of relative rotation may be required for the cutting member to at least partially sever the line of weakness in which the second amount may be greater than the first amount. The second amount may be approximately 2-10° greater than the first amount.

The base cap may include an annular groove and the overcap may include a locking structure rotatably received within the groove to axially lock the overcap to the base cap. The inner overcap skirt may include a sealing bead extending around the lower end of the inner overcap skirt in which the sealing bead engages an inner surface of the well to provide a seal between the base cap and the overcap.

The overcap may include a pushing member having a lower end positioned adjacent the cutting member wherein the pushing member engages the membrane and pushes the membrane open upon substantial rotation of the overcap with respect to the cap base. The closure may further include a rotation lock that engages upon full rotation of the overcap with respect to the base cap. Full rotation may be in the range of approximately 300-330°. Full rotation may be approximately 315°. The rotation lock may include an outwardly-directed lock recess on the base cap and an inwardly-extending lock projection extending inwardly from an inner surface of the overcap body. The rotation lock may be configured to produce an audible sound upon engagement of the lock projection into the lock recess.

The well and the inner overcap skirt may form a sealed chamber and the closure further may include a consumable material in the chamber. The consumable material may be a tablet.

The overcap may include an aperture and the closure may include a dust cap having a plug for sealing the aperture. The dust cap may include a tamper-evidencing dust-cap band frangibly connected to a lower end of the dust cap and operably engaging tamper-evidencing structure on the base cap.

The twist-open closure of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
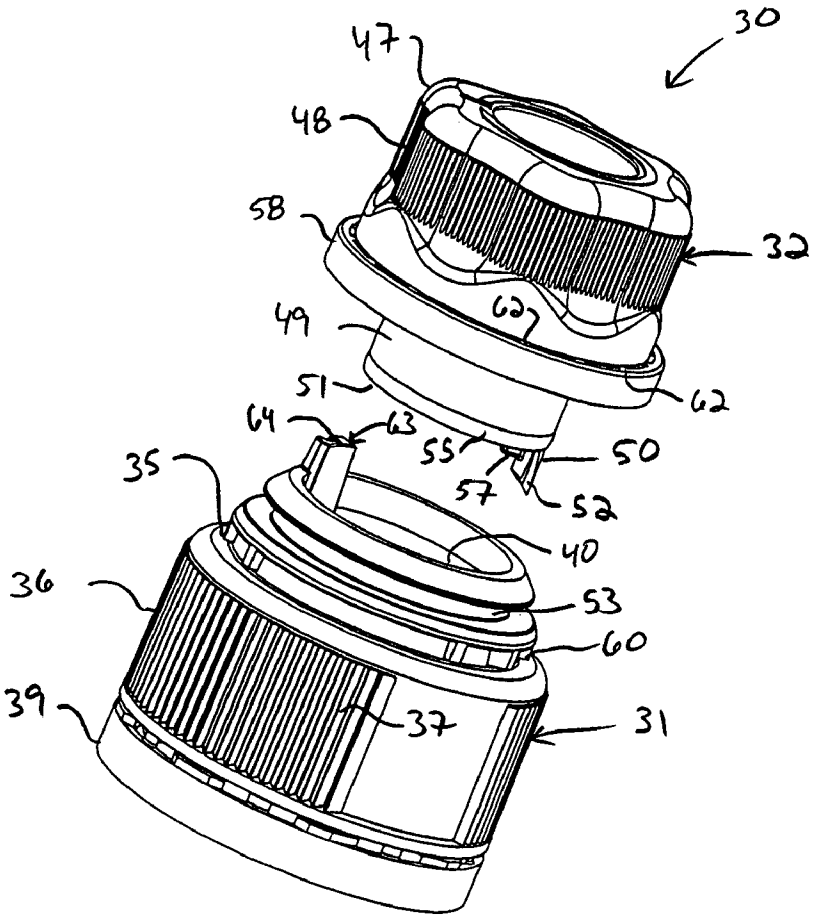
FIG. 1 is an exploded perspective side view of twist-open closure including a base cap and an overcap in accordance with the present invention.

A closure 30 in accordance with the present invention is shown in FIG. 1. The illustrated closure can be used with a container of the type often used for bottled water, sport drinks and other flowable bottled substances. The closure of the present invention is particularly suited for use with containers having a liquid that is to be mixed with a consumable including, but not limited to, tablets, powders and liquids by the consumer at the time of consumption. In some aspects, the closure is similar to that disclosed by U.S. patent application Ser. No. 10/313,575, the entire content of which is incorporated herein by this reference.

Figure 4:
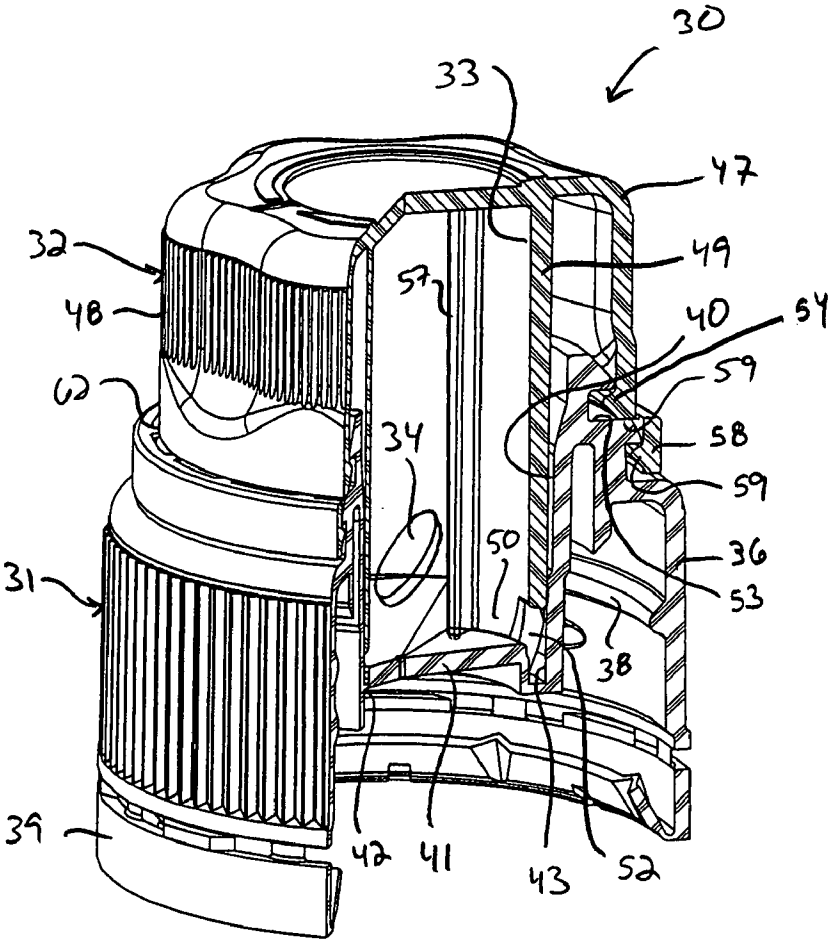
FIG. 4 is a partial cross-sectional perspective side view of the assembled closure of FIG. 1.

The closure of the present invention generally includes a cap base 31 adapted for releasably engaging the container and an overcap 32 rotatably mounted on the cap base to form a chamber 33 therebetween (see FIG. 4). The closure contains a consumable 34 (schematically illustrated as a tablet in FIG. 4) that may be mixed with, or otherwise introduced to the contents of the container to which closure is mounted when closure is initially opened.

Preferably, the cap base and the overcap are formed as monolithic thermoplastic members using various methods including, but not limited to, injection molding techniques well known in the art. The cap base and the overcap may be formed of various materials including, but not limited to, low-density polyethylene, linear low-density polyethylene, high-density polyethylene, polypropylene, polystyrene, and/or other suitable materials. Preferably the overcap is formed of a harder material than the cap base in order to facilitate cutting into the slanted membrane. For example, the overcap may be formed of a high-density polyethylene and the cap base may be formed of a low-density polyethylene.

In the illustrated embodiment, the cap base is generally dimensioned and configured to cooperate with a container having a tamper-evident neck finish of the type shown in U.S. Pat. No. 6,112,923 to Ma, the entire contents of which is incorporated herein by this reference. One should appreciate, however, that the cap base can be adapted to cooperate with other container neck finishes within the scope of the present invention. For example, a cap in accordance with the present invention can be adapted to cooperate with a container having a snap-on, screw-off cap neck finish of the type shown in U.S. Pat. No. 6,173,853 to Luch, the entire contents of which is incorporated herein by this reference. Alternatively, other cooperative closure-container retention structure, such as a simple snap engagement, can also be employed in accordance with the present invention.

The cap base includes a cap top 35. Although the annular surfaces of the cap top illustrated in FIG. 1 is planar, the cap top can alternatively have a frustoconical or other suitable shape. A base-cap outer skirt 36 depends downwardly from the cap top in a well-known manner. The base cap outer skirt includes vertically extending ribs 37 extending from an external surface thereof to provide a gripping surface for facilitating a user in gripping and turning the cap base to screw the closure on and off from a respective container. The cap skirt also includes a container-engaging member extending from an internal surface of the cap skirt. In the illustrated embodiment, the container-engaging member includes internal threads 38. As noted above, the cap can be adapted for use with various container-neck finishes, in which case a different thread or snap fit configuration can be used. Preferably, a tamper-evident base band 39 is frangibly connected to a bottom portion of the cap skirt and is adapted to detachably engage the container in a well known manner, as described in the '923 Ma patent.

The base cap also includes a cylindrical well 40 and a frangible membrane 41 connected to and fluidly sealing the bottom of the well, as can be seen in FIG. 4. The membrane is connected to the well along an inclined line of weakness 42 and by a thickened-material hinge member 43 such that the membrane remains attached to the well by the hinge member even after the line of weakness has been separated, as described below. In one embodiment, the hinge member includes a pocket 44 that extends downwardly adjacent the lower terminus 45 and the upper terminus 46 of the line of weakness.

The overcap includes an overcap body 47 having gripping structure 48, and an inner skirt 49 received within and in rotatable contact with the well. The overcap further includes a cutting-member 50 depending from a lower end 51 of the inner skirt received within the pocket such that the cutting member extends below the upper terminus and adjacent the lower terminus of the line of weakness. Preferably, the cutting member also extends into the pocket to a level that is slightly below the lower terminus in order to ensure that the cutting member severs the line of weakness and thus severs the connection between the frangible membrane and the well.

Figure 3:
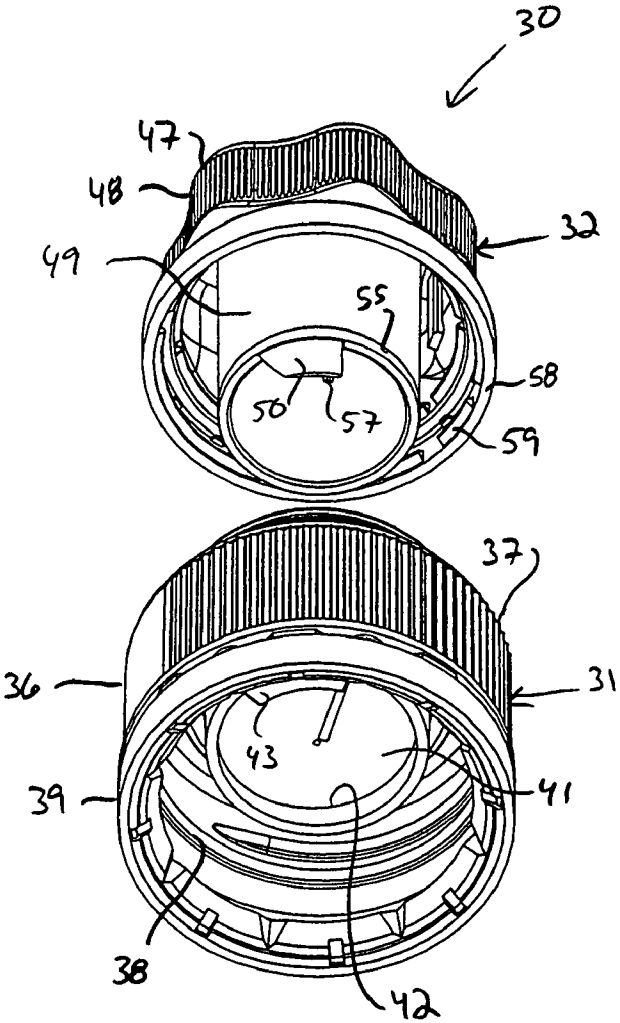
FIG. 3 is an exploded perspective bottom view of the closure of FIG. 1 similar to that shown in FIG. 2 but rotated approximately 90°.
Figure 6:
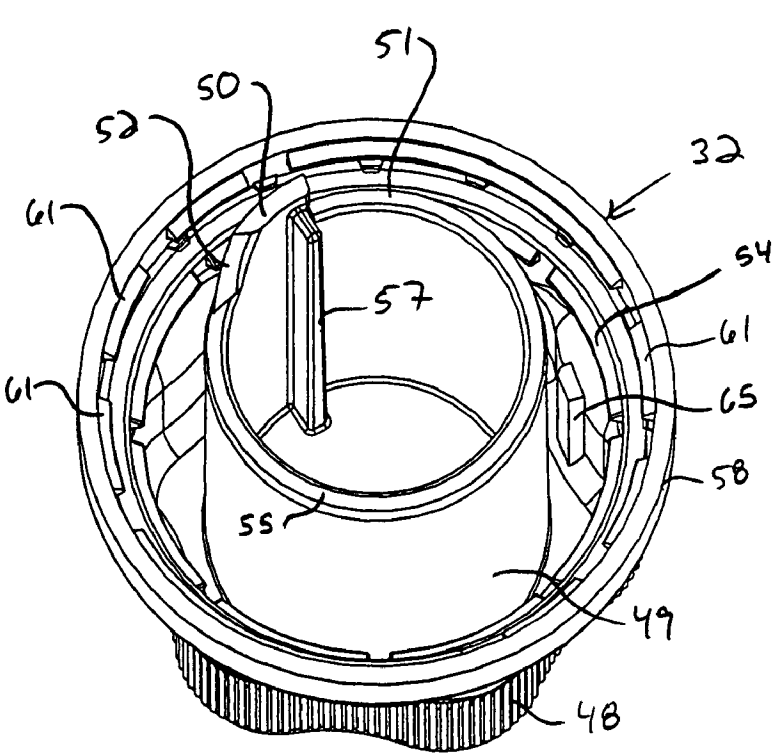
FIG. 6 is a perspective bottom view of the overcap of FIG. 1.
Figure 5:
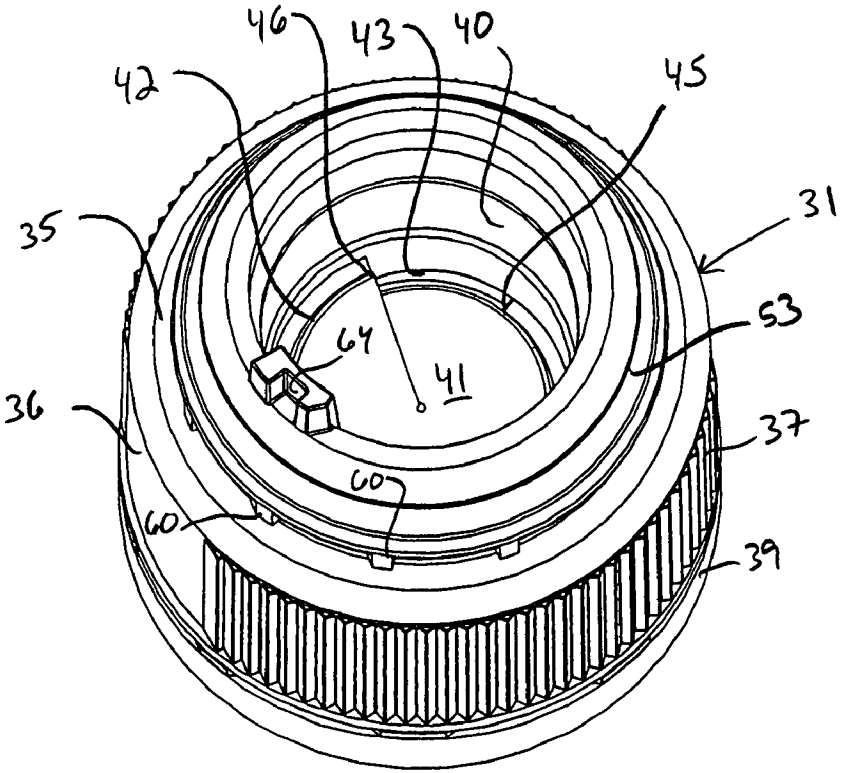
FIG. 5 is a perspective top view of the base cap of FIG. 1.

The line of weakness extends along a helical path thus providing the frangible membrane with a slanted or inclined configuration, as can be seen in FIG. 3 and FIG. 4. Such a slanted-membrane configuration allows the cutting member to gradually cut into the line of weakness thus reducing the amount of twisting force necessary for a user to initiate cutting.

Preferably, the cutting member is approximately one-sixteenth to one-half inches high, and most preferably, approximately one-eighth inch high. One will appreciate that the actual height of the cutting member will vary depending upon the dimensions of the frangible membrane. In this regard, the cutting member is preferably slightly taller than the vertical distance between lower and upper termini of the line of weakness. The cutting member may include an angled knife-edge 52 in order to facilitate cutting along the line of weakness.

In one embodiment, the base cap includes an annular groove 53 and the overcap includes locking structure such as, but not limited to, a locking bead 54 rotatably received within the groove to axially lock the overcap to the base cap. Preferably, the inner overcap skirt includes a sealing bead 55 extending around the lower end of the inner overcap skirt and engages an inner surface 56 of the well in order to provide an effective seal between the base cap and the overcap. Such configuration facilitates isolation of the consumable or like item from the liquid or other contents of the container. One will appreciate that the seal may be fluid-tight, airtight and/or other suitable seal designed according to the package requirements. For example, the seal may be configured to provide an airtight seal if required to protect ingredients contained within the chamber from atmospheric moisture, air, oxygen or other ambient environment.

Figure 2:
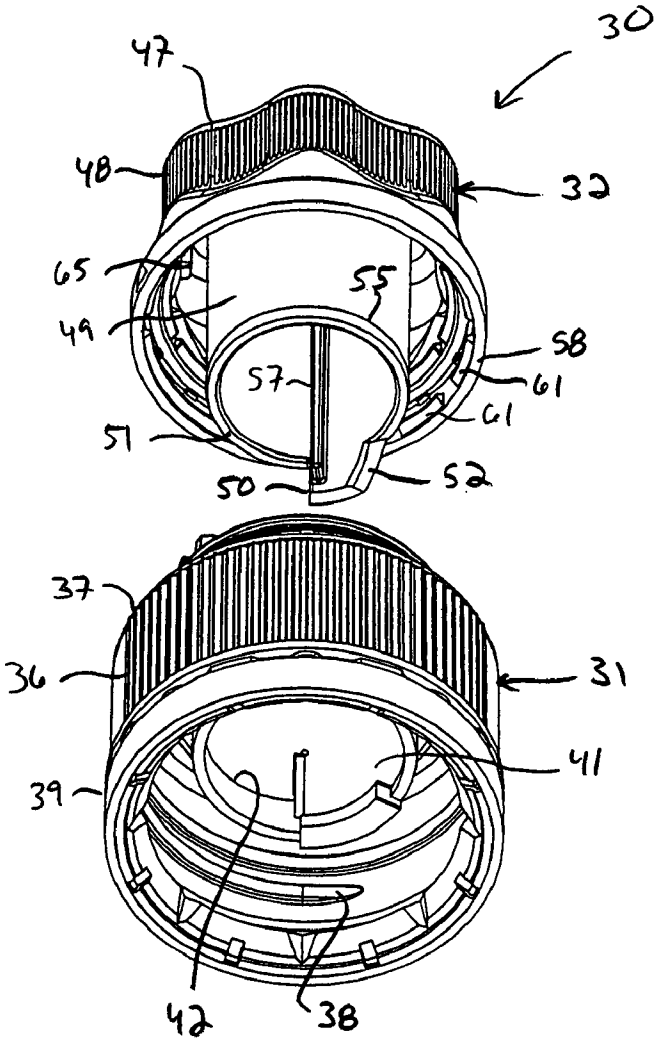
FIG. 2 is an exploded perspective bottom view of the closure of FIG. 1.

Turning now to FIG. 2 and FIG. 4, the pocket of the hinge member extends in an arcuate manner along the peripheral edge of the frangible membrane. The pocket may extend approximately 5-180°, preferably approximately 5-90°, and more preferably approximately 30-60° along the peripheral edge of the frangible membrane. In the illustrated embodiment, extends approximately 45°. Such a circumferentially-extending configuration allows a certain amount of relative rotation between the overcap and the base cap before the cutting member cuts into the frangible membrane along the line of weakness. For example, in one embodiment, the relative rotation between the overcap and the base cap must exceed approximately 0-10° to cause the cutting member to at least partially sever the line of weakness.

Figure 8:
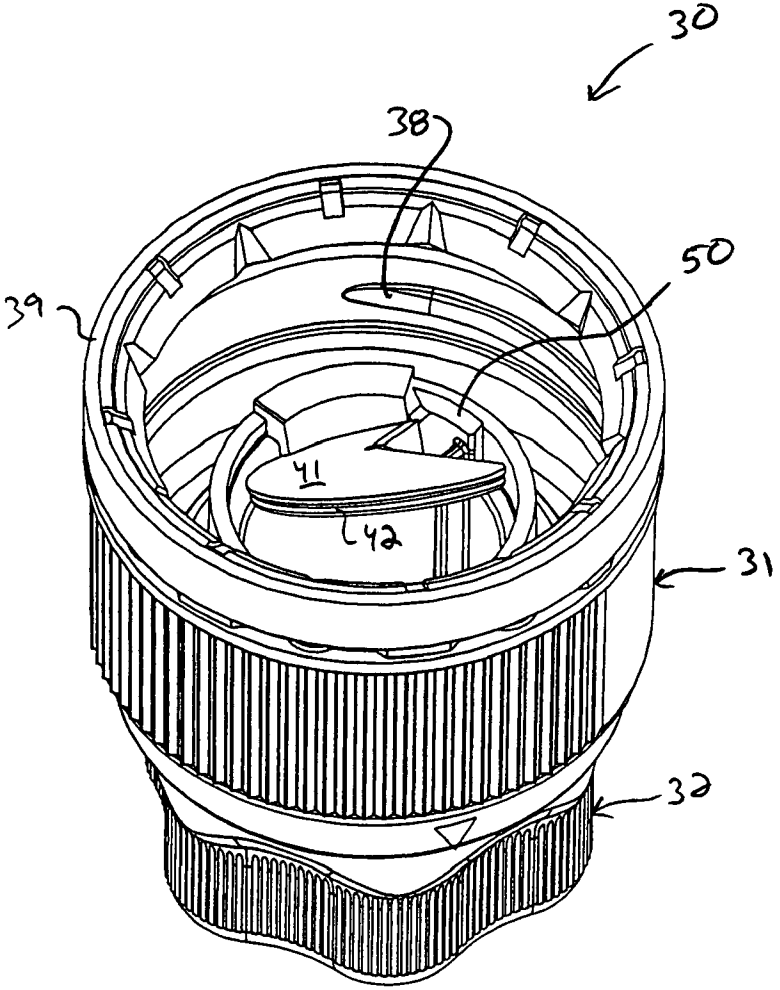
FIG. 8 is a perspective bottom view of the assembled closure of FIG. 1 showing an opened frangible membrane of the base cap.
Figure 7:
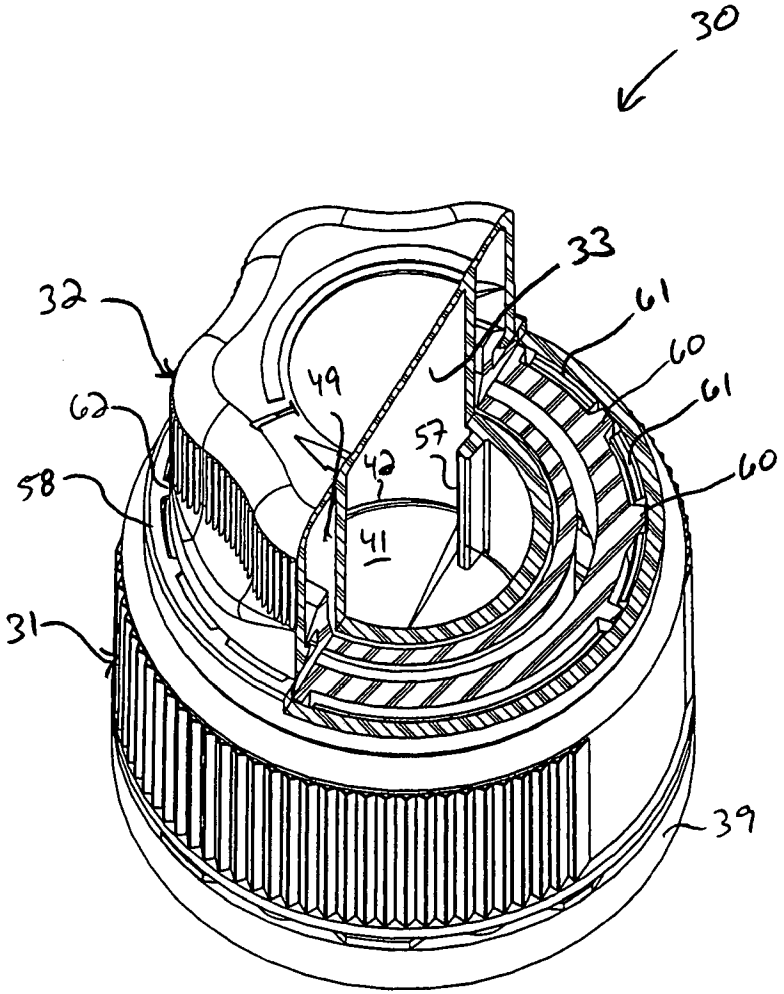
FIG. 7 is a partial cross-sectional perspective top view of the assembled closure of FIG. 1.
Figure 10:
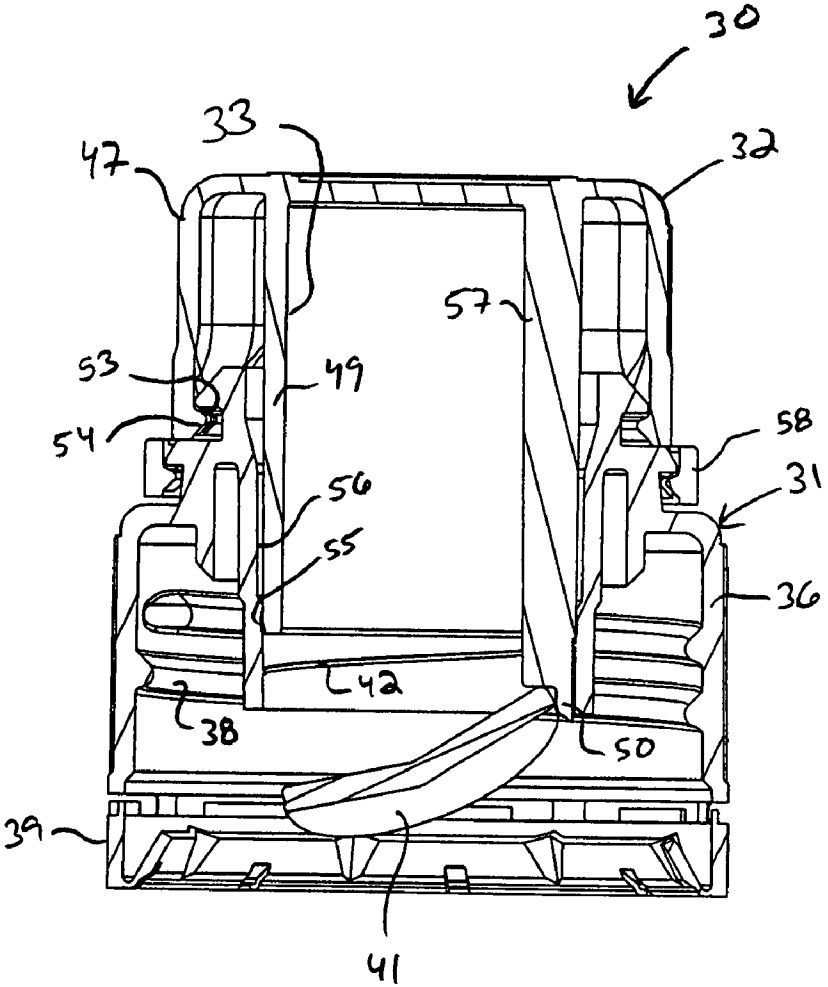
FIG. 10 is a cross-sectional side perspective side view of the assembled closure of FIG. 1 taken along line 10-10 of FIG. 9.
Figure 9:
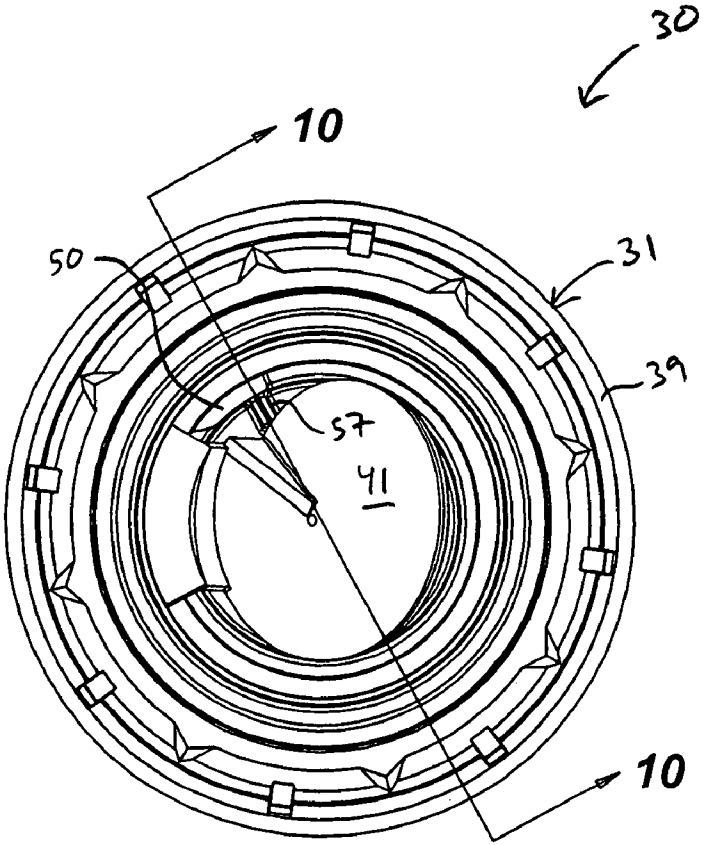
FIG. 9 is a bottom view of the closure of FIG. 1 showing the opened frangible membrane.
Figure 12:
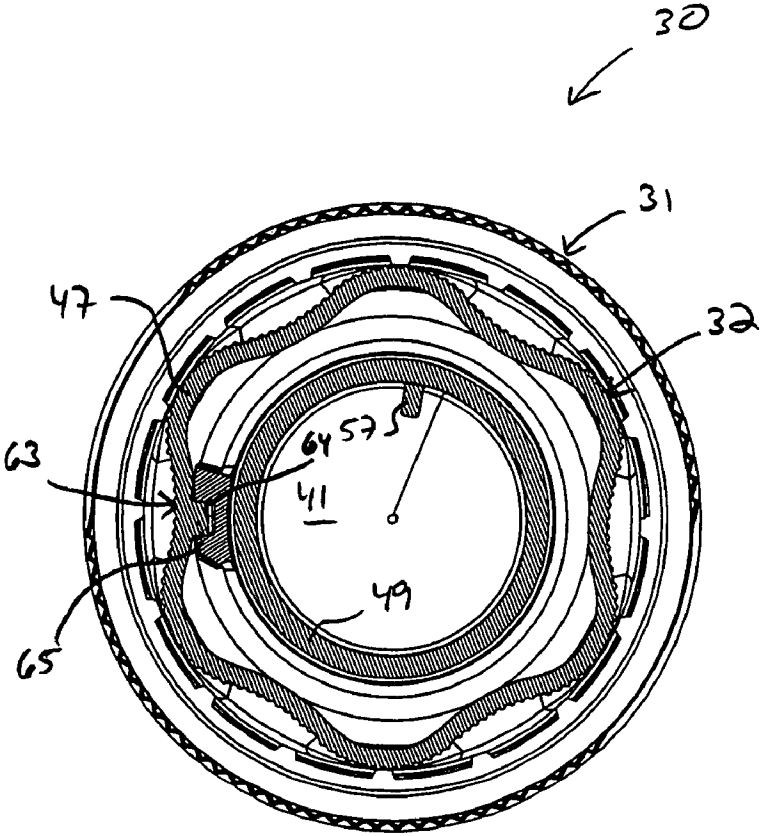
FIG. 12 is a cross-sectional top view of the assembled closure of FIG. 1 taken along line 12-12 of FIG. 11.
Figure 11:
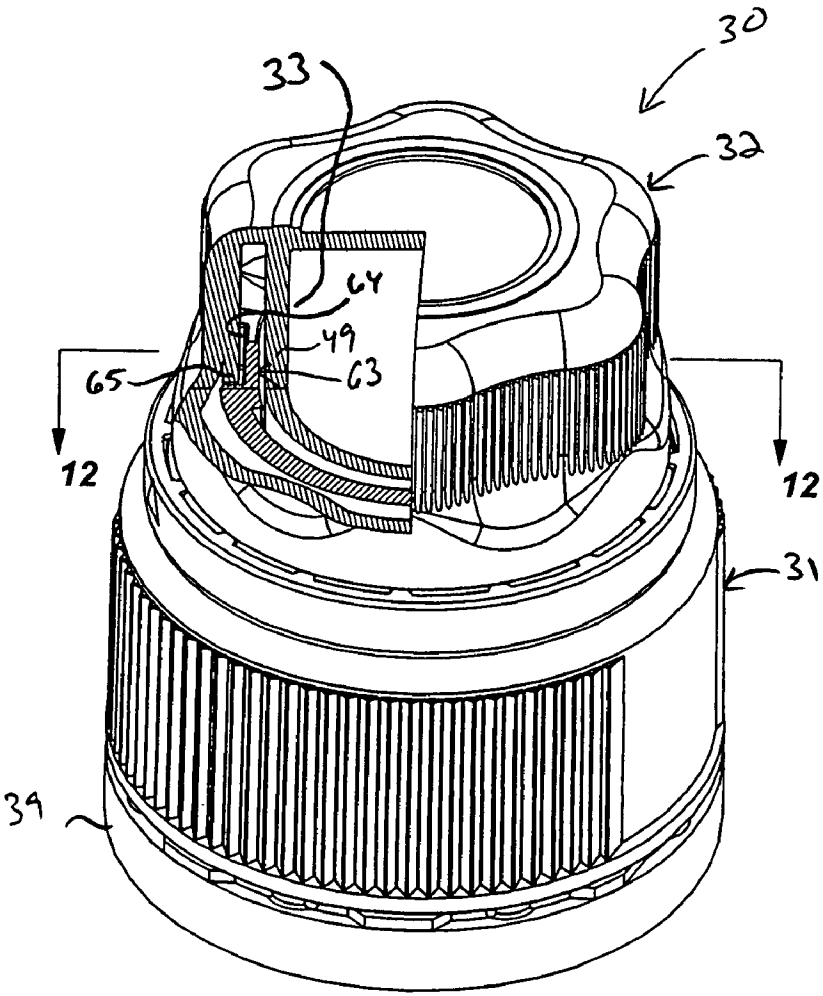
FIG. 11 is a partial cross-sectional perspective top view of the assembled closure of FIG. 1.
Figure 14:
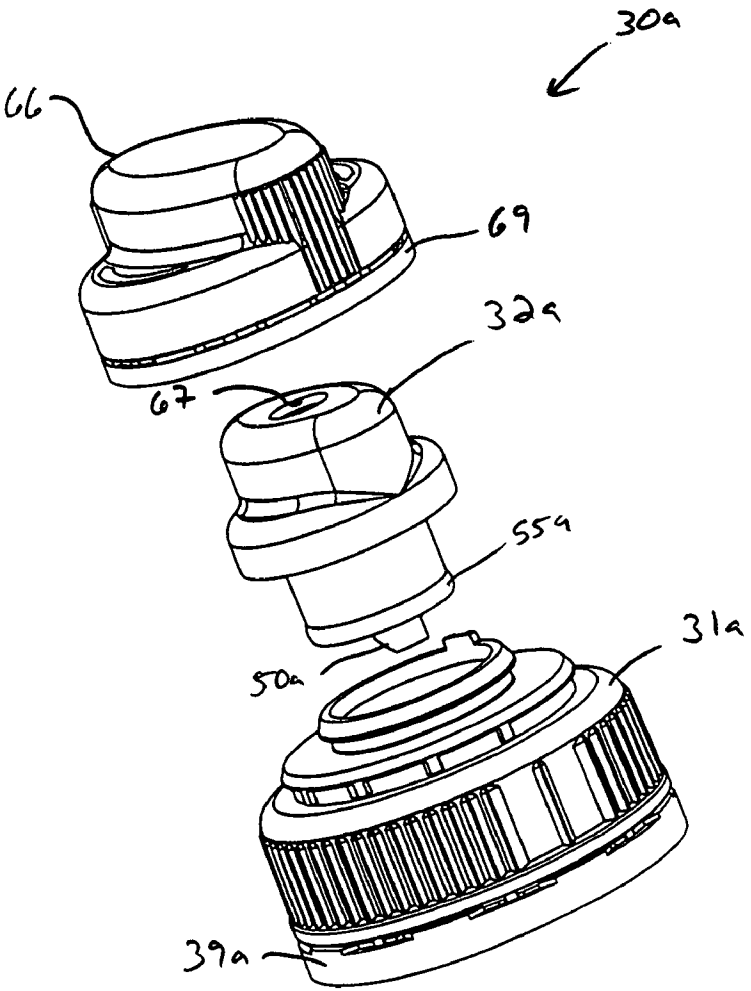
FIG. 14 is an exploded perspective side view of the closure of FIG. 13.
Figure 13:
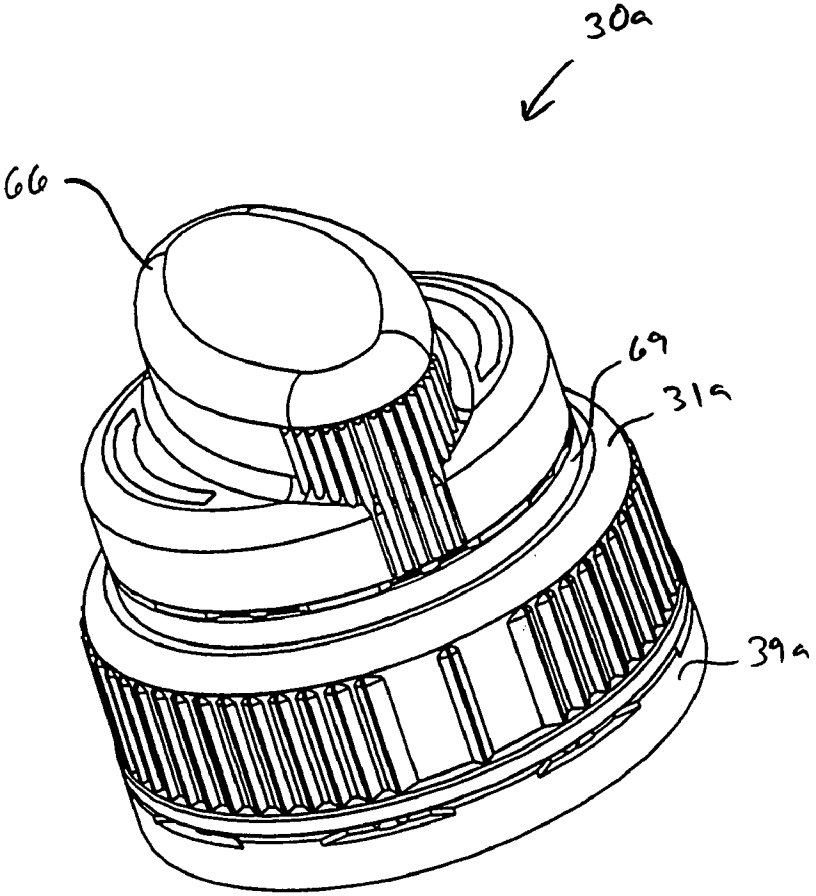
FIG. 13 is an assembled perspective side view of another twist-open closure including a base cap, an overcap and a dust cap in accordance with the present invention.
Figure 16:
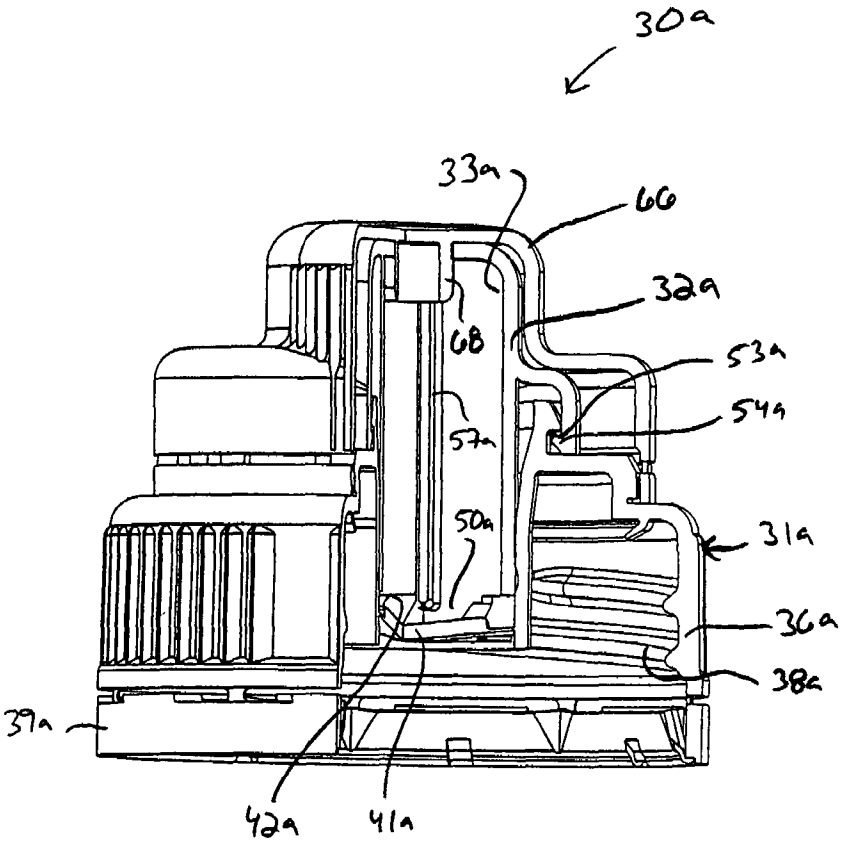
FIG. 16 is a partial cross-sectional perspective side view of the assembled closure of FIG. 13.
Figure 15:
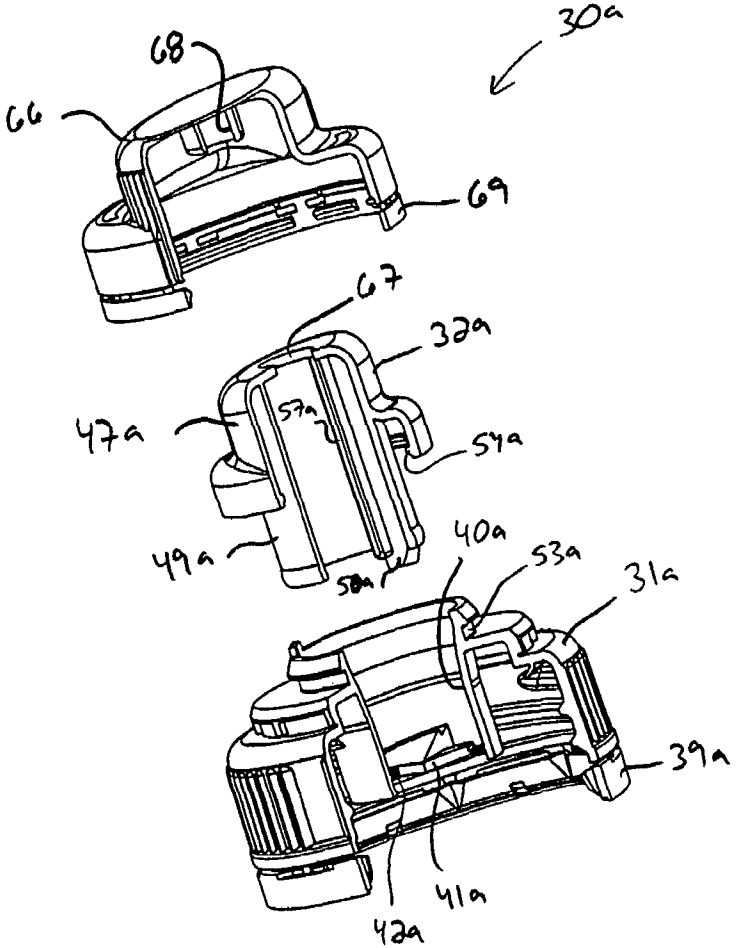
FIG. 15 is a partial cross-sectional exploded perspective side view of the closure of FIG. 13.

As a user continues to rotate the overcap, the cutting member continues to cut along the line of weakness thus opening the chamber defined by the well to the interior and/or contents of the container to which the closure is mounted. In one embodiment, the overcap includes a pushing member 57 having a lower end positioned adjacent the cutting member. The pushing member engages the membrane and pushes the membrane open upon substantial rotation of the overcap with respect to the cap base, as shown in FIG. 7 and FIG. 8. In this regard, the pushing member rides along the periphery of the membrane from the lower terminus to the upper terminus, contacting the membrane and biasing the membrane downwardly as shown in FIG. 10. For the purpose of the present invention, substantial rotation refers to the amount of rotation required for the cutting member to sever a sufficient portion of the line of weakness to allow the frangible membrane to fold or otherwise displace downwardly allowing a consumable or other item located within the well to fall downwardly into the interior and/or contents of the container.

In one embodiment, the overcap includes a tamper-evidencing overcap band 1 that is frangibly connected to a lower end 2 of the overcap body. The overcap band is dimensioned and configured to operably engage a tamper-evidencing structure 3 on the base cap. In one embodiment, the overcap band includes an inwardly-extending protrusion such as, but not limited to, the illustrated segmented bead 4 that operably engages the tamper-evidencing structure of the base cap. The inwardly-extending protrusion and the base-cap tamper-evidencing structure cooperate to prevent rotation of the overcap with respect to the base cap without breaking one or more overcap bridges 5 that frangibly connect the overcap band to the overcap body. Preferably, the tamper-evidencing structure includes one or more outwardly-extending protrusions, however, one will appreciate that other tamper-evidencing configurations may be utilized in accordance with the present invention including, but not limited to splines, ratchet teeth, and/or other suitable anti-rotation means. The overcap bridges are configured to fail upon relative rotation between the overcap and the base cap.

In one embodiment, relative rotation between the overcap and the base cap exceeding approximately 0-5° causes the overcap band to at least partially separate from the overcap body, however, one will appreciate that the actual amount of rotation may vary in accordance with the present invention. Preferably, a first amount of relative rotation between the overcap and the base cap required to initiate separation of the overcap band from the overcap body is less than the relative rotation that is required for the cutting member to initiate severance of the line of weakness. In particular, as a user twists the overcap relative to the cap base, the frangible bridges will fail before the cutting member initiates cutting of the frangible membrane thus providing a visual indication that someone may have tampered with the closure, and the container upon which it is mounted, even before the frangible membrane is damaged. In one embodiment, second amount is approximately 2-10° greater than the first amount, which is substantially equal to the angular distance between the knife-edge and the lower terminus.

In one embodiment, the closure further includes a rotation lock 63 that engages upon full rotation of the overcap with respect to the base cap. Preferably, full rotation is greater than approximately 180°, more preferably within the range of approximately 300-330°, and most preferably approximately 315°. The rotation lock includes an outwardly-directed lock recess 64 on the base cap and an inwardly-extending lock projection 65 extending inwardly from an inner surface of the overcap body. The rotation lock may be configured to produce an audible sound upon engagement of the lock projection into the lock recess.

The method of using the closure in accordance with the present invention can now be described. Closure 30 may be assembled prior to its application onto a container. In particular, the well of the base cap and/or the cylindrical skirt of the overcap may be provided with a consumable item. The base cap and overcap are then assembled by inserting the cylindrical skirt into the well such that the consumable item is located in the chamber formed between the cylindrical skirt and the well. The chamber is sealed from exterior of the closure and thus is also isolated from the contents of the container upon which the closure is mounted.

In operation and use, a user will hold the container and twist the overcap relative to the base cap and the container. Upon a first amount of relative rotation, the connecting bridges of the overcap band fail thus providing visual indication of tampering. With continued rotation of the overcap relative to the base cap, the cutting member begins to cut into and along the line of weakness thus partially separating the frangible membrane from the well and exposing the chamber, and the consumable therein, with the interior and contents of the container. Continued rotation of the overcap causes the pushing member to bias the membrane downwardly thus facilitating the introduction of the consumable item into the contents of the container. The user may continue rotating the overcap to the point of full rotation thereby activating the rotation lock. Namely, once full rotation is accomplished, the lock projection snaps into the lock recess thus providing the user with an audible click indicating that the closure chamber is fully opened. The configuration of the rotation lock discourages and/or prevents reverse relative rotation of the overcap with respect to the cap base thus ensuring that the pushing member prevents the frangible membrane from returning to its initial position.

Advantageously, the slanted-membrane configuration of the present invention allows for a closure that is relatively simple to manufacture. The overcap may simply be aligned and snapped onto the base cap without twisting. Also, the configuration of the present invention also provides for a compact design. As the closure does not require axial motion to pierce the membrane, the closure may have smaller axial dimensions and/or a lower profile.

In another embodiment of the present invention, closure 30*a* is similar to closure 30 described above but includes a dust cap 66 as shown in FIG. 13 through FIG. 16. Like reference numerals have been used to describe like components of closure 30 and closure 30*a*. In this embodiment, the overcap includes an aperture 67 which allows dispensing of the container contents once the frangible membrane has been opened. The dust cap including a plug 68 for sealing the aperture.

Preferably, the dust cap includes a tamper-evidencing dust-cap band 69 frangibly connected to a lower end of the dust cap and operably engages cooperating tamper-evidencing structure on the base cap. In operation and use, closure 30*a* is used is substantially the same manner as closure 30 discussed above.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by subscript "a" designates corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A closure for a container having an opening, said closure comprising:

a base cap including an outer skirt having container-engaging structure, a cylindrical well defining a chamber for containing and supporting a consumable or other item located therein, a frangible membrane connected to said well along an inclined line of weakness and by a hinge member within said well, said hinge member having a pocket extending downward adjacent lower and upper terminuses of said line of weakness; and an overcap including a body having gripping structure, an inner skirt received within and rotatably connected to said well, and a cutting member depending from a lower end of said inner skirt substantially received within said pocket such that said cutting member extends below said lower terminus when said base cap is assembled to said overcap, whereby said cutting member severs said line of weakness upon substantial rotation of said overcap with respect to said base cap;

wherein said base cap includes an annular groove and said overcap includes a locking structure rotatably received within said groove to axially fix said overcap with respect to said base cap during severing of the line of weakness.

2. A closure according to claim 1, wherein said cutting member includes an angled knife edge.

3. A closure according to claim 1, wherein relative rotation between said overcap and said base cap in excess of approximately 0-10° causes said cutting member to at least partially sever said line of weakness.

4. A closure according to claim 1, wherein said container-engaging structure includes container-engaging thread dimensioned and configured to cooperate with closure-engaging thread of the container.

5. A closure according to claim 1, further comprising a tamper-evidencing base band frangibly connected to a lower end of said outer base cap skirt.

6. A closure according to claim 1, further comprising a tamper-evidencing overcap band frangibly connected to a lower end of said overcap body and operably engaging tamper-evidencing structure on said base cap.

7. A closure according to claim 6, wherein said overcap band includes a inwardly-extending protrusion extending inwardly and operably engaging an outwardly-extending protrusion on said base cap.

8. A closure according to claim 6, wherein relative rotation between said overcap and said base cap in excess of approximately 0-5° causes said overcap band to at least partially separate from said overcap body.

9. A closure according to claim 6, wherein a first amount of relative rotation between said overcap and said base cap is required to at least partially separate said overcap band from said overcap body and a second amount of relative rotation is required for said cutting member to at least partially sever said line of weakness, said second amount being greater than said first amount.

10. A closure according to claim 9, wherein said second amount is approximately 2-10° greater than said first amount.

11. A closure according to claim 1, wherein said inner overcap skirt includes a sealing bead extending around said lower end of said inner overcap skirt, said sealing bead engaging an inner surface of said well to provide a seal between said base cap and said overcap.

12. A closure according to claim 1, wherein said overcap further includes a pushing member having a lower end positioned adjacent said cutting member wherein said pushing member engages said membrane and pushes said membrane open upon substantial rotation of said overcap with respect to said cap base.

13. A closure according to claim 1, wherein said closure further includes a rotation lock that engages upon full rotation of said overcap with respect to said base cap.

14. A closure according to claim 13, wherein full rotation is approximately 300-330°.

15. A closure according to claim 13, wherein said rotation lock includes an outwardly-directed lock recess on said base cap and an inwardly-extending lock projection extending inwardly from an inner surface of said overcap body.

16. A closure according to claim 15 wherein said rotation lock produces an audible sound upon engagement of said lock projection into said lock recess.

17. The closure of claim 1, wherein said well and said inner overcap skirt form a sealed chamber, said closure further comprising a consumable material in said chamber.

* * * * *

UNITED STATES PATENT AND TRADEMARK OFFICE

CERTIFICATE OF CORRECTION

PATENT NO. : 7,337,921 B2
APPLICATION NO. : 10/525143
DATED : March 4, 2008
INVENTOR(S) : Mike Xiaolii Ma It is certified that error appears in the above-identified patent and that said Letters Patent is hereby corrected as shown below:

Col. 10 lines 12-13 should read,
18. The closure of claim 1, wherein said overcap includes an aperture, said closure further comprising a dust cap including a plug for sealing said aperture.

Col. 10 lines 14-16 should read,
19. The closure of claim 18 wherein said dust cap includes a tamper-evidencing dust cap band frangibly connected to a lower end of said dust cap and operably engaging tamper-evidencing structure on said base cap.

Signed and Sealed this

Third Day of March, 2009

John Doll

JOHN DOLL
*Acting Director of the United States Patent and Trademark Office*